United States Patent [19]

Crowe

[11] 3,971,438

[45] July 27, 1976

[54] WIRELINE SAFETY VALVE WITH SPLIT BALL

[75] Inventor: Talmadge L. Crowe, Houston, Tex.

[73] Assignee: Baker Oil Tools, Inc., Orange, Calif.

[22] Filed: Mar. 3, 1975

[21] Appl. No.: 554,623

[52] U.S. Cl. ..... 166/224 A; 137/460; 251/58

[51] Int. Cl.[2] ..... F16K 11/16; E21B 43/12

[58] Field of Search ..... 166/224 R, 224 A, 72, 166/53; 137/460, 629; 251/58, 62

[56] References Cited

UNITED STATES PATENTS

| | | | |
|---|---|---|---|
| 3,543,793 | 12/1970 | Dollison | 166/224 A X |
| 3,703,193 | 11/1972 | Raulins | 137/629 X |
| 3,741,249 | 6/1973 | Leutwyler | 166/224 A X |
| 3,763,933 | 10/1973 | Mott | 166/224 A |
| 3,796,257 | 3/1974 | Hudson | 166/224 A X |
| 3,799,204 | 3/1974 | Watkins et al. | 166/224 A X |
| 3,868,995 | 3/1975 | Crowe | 166/224 A |
| 3,874,634 | 4/1975 | Gazda | 166/224 A X |

*Primary Examiner*—James A. Leppink
*Attorney, Agent, or Firm*—Bernard Kriegel

[57] ABSTRACT

A subsurface safety valve for wells has a ball valve supported for rotation between open and closed positions in response to control fluid pressure supplied from the top of the well and a spring which overcomes the hydrostatic pressure of the control fluid. The ball is split and has a pressure equalizing flow passage through a ball cap initially opened before the ball is rotated, the ball valve base including a screen to preclude entry of large particles. An adjustable connection in the valve support and housing structure enables adjustment to compensate for tolerances and effect snug engagement of the ball cap with its seat. Control fluid pressure enters the pressure responsive region through a balanced sleeve. An internal spring guide has a seat adjustable relative to the valve housing to provide a smooth continuous bore when the valve is open. The valve closing spring is disposed about the spring guide and engages an adjustable seat, the spring being exposed at its outer diameter to enable use of springs of large selected sizes and strengths for different depths of valve installation.

28 Claims, 18 Drawing Figures

F
H
33
11
P
C
T
20
33
N
W
34
23
10

103
102
107
108
107
107a
105
106
110
109
114a
114
114b
112c
B
113
86a
112e
112d
112a
104
112
112b

WIRELINE SAFETY VALVE WITH SPLIT BALL

In the production of well fluids, such as oil and/or gas, from wells situated at remote locations, it has become the practice to employ automatic shutoff valves which are responsive to the pressure of well fluids so as to be actuated from an opened condition to a closed condition in the event of loss of well fluids as may be caused by various circumstances. For example, it may occur that a well located at sea may suffer damage which will allow well fluids to flow into the sea, not only resulting in loss of well fluids until the well can be killed, but also resulting in contamination of the sea water and the seashore when oil escapes into the sea and drifts ashore. It is also desirable to prevent the uncontrolled loss of well fluids from remotely located onshore wells where damage may occur to the wellhead equipment, resulting in the uncontrolled flow of the well until it can be killed.

Various valves have been heretofore developed for the purposes of automatically shutting off such a flowing well, at a subsurface location in the production pipe string, including sleeve type valves and ball type valves which have a substantially full bore opening therethrough and thereby cause no substantial restriction to flow. However, such ball valves experience operating difficulties, particularly when they are being opened and the well fluid pressure below the valve, which is holding the valve closed, is substantial, causing a high friction loading between the sealing faces and the surface of the ball with which they are sealingly engages. Indeed, the operating means for shifting the ball to an open position may, in some instances, be destroyed.

Ball valves have been incorporated in subsurface safety valves, wherein a balancing valve equalizes the fluid across the closed ball valve before the ball valve is opened, thereby reducing the wear and frictional resistance to ball actuation, as disclosed in my pending application for Letters Patent of the United States, filed Nov. 3, 1972, Ser. No. 303,482, now U.S. Pat. No. 3,850,242.

As disclosed in my application for Letters Patent of the United States, filed June 15, 1973, Ser. No. 370,354, now U.S. Pat. No. 3,868,995, there is provided an automatic subsurface shutoff valve of the ball type, wherein the ball is easy to manipulate from the closed to the open position, notwithstanding high well fluid pressure tending to hold the valve closed. More particularly, a control fluid operated by-pass valve is incorporated in the ball assembly, so that as control fluid pressure is being supplied to open the ball valve, the pressure differential across the ball valve is first equalized, and then the ball valve is shifted to the open position. To accomplish this, the ball valve is composed of a ball base and ball cap providing a by-pass passage which is opened when the ball base is shifted relative to the cap. In addition to the foregoing, actuation of the ball valve to the closed position is assisted by a spring, so that even in the absence of sufficient well pressure to assure closure of the shutoff valve, the latter will be nevertheless closed and the sealing effectiveness of the valve will be maintained.

The present invention provides an improved subsurface valve of the general type of the two above-identified applications, and more particularly of the split ball type of U.S. Pat. No 3,868,995.

In this connection, the present invention provides a subsurface safety valve for wells, wherein the ball valve is split to provide a ball base and a ball cap which cooperate to provide an equalizing fluid path for initially relieving the ball valve of differential pressure before the ball valve is opened, wherein the ball base and the ball cap have screening passages which are smaller than the equalizing fluid path so that particles, such as sand or the like, cannot cause blockage of the equalizing path or passage in the ballcap. A resilient seal is molded into the ball base between the screen openings and the fluid passage in the cap to provide a seal when the ball valve is in the closed position.

The present invention also provides a valve supporting and housing structure which is adjustable to assure snug seating of the ball cap against its sleeve. This is accomplished by adjustably mounting a valve supporting sleeve on an upper mandrel so that adjustment of the sleeve longitudinally with respect to the mandrel adjusts the ball valve with respect to its seat.

The adjustable sleeve, in addition, interconnects the upper mandrel with a lower mandrel, the two mandrels having seals engageable in the usual landing nipple, when the valve assembly is lowered into place, to form a seal at opposite sides of the control fluid port in the landing nipple. The adjustable sleeve is ported between the seals to allow communication between the control fluid pressure port and the pressure chamber in the valve assembly to which control fluid pressure is applied to open the valve. The ported sleeve is, therefore, pressure balanced and need not be thick-walled, so that maximum internal space is available for other components and a large central flow passage.

An internal spring guide is provided for the spring which acts to overcome the control fluid pressure when the valve is closed, but the spring is not externally enclosed or guided. Thus, the spring can be of relatively large diameter and strong so as to overcome substantial control fluid pressure, thereby enabling the valve to be employed at a greater depth, say well below the mudline, in the case of an offshore well in relatively deep water, or below the point where paraffin forms in the well pipe and might interfere with valve operation.

This internal spring guide, moreover, is adjustable with respect to the valve body or support and has an internal diameter substantially corresponding with the opening in the ball valve. The guide has an end surface which can be positioned for engagement by the ball base and ball cap when the ball valve is open, and, thus, a smooth bore through the valve assembly is provided.

This invention possesses many other advantages, and has other purposes which may be made more clearly apparent from a consideration of a form in which it may be embodied. One form is shown in the drawings accompanying and forming part of the present specification. It will now be described in detail, for the purpose of illustrating the general principles of the invention; but it is to be understood that such detailed description is not to be taken in a limiting sense.

Referring to the drawings:

FIG. 1 is a diagrammatic view illustrating an offshore well, in which a subsurface automatic shutoff valve has been installed;

FIGS. 2*a*, 2*b*, 2*c*, 2*d* and 2*e* together constitute a longitudinal quarter section showing one form of automatic shutoff valve embodying the invention, with the valve in the closed condition, FIGS. 2*b* through 2*e*, respectively, constituting successive downward continuations of FIG. 2*a;*

FIGS. 3*a* and 3*b* together constitute a fragmentary longitudinal section of the portions of the valve assembly seen in FIGS. 2*a* through 2*e*, showing the valve in the closed position but in a pressure balanced condition with the by-pass valve open, FIG. 3*b* being a downward continuation of FIG. 3*a;*

FIGS. 4*a* and 4*b* together constitute a fragmentary longitudinal quarter section showing the valve in the open position, FIG. 4*b* being a downward continuation of FIG. 4*a;*

Figures 1, 7:
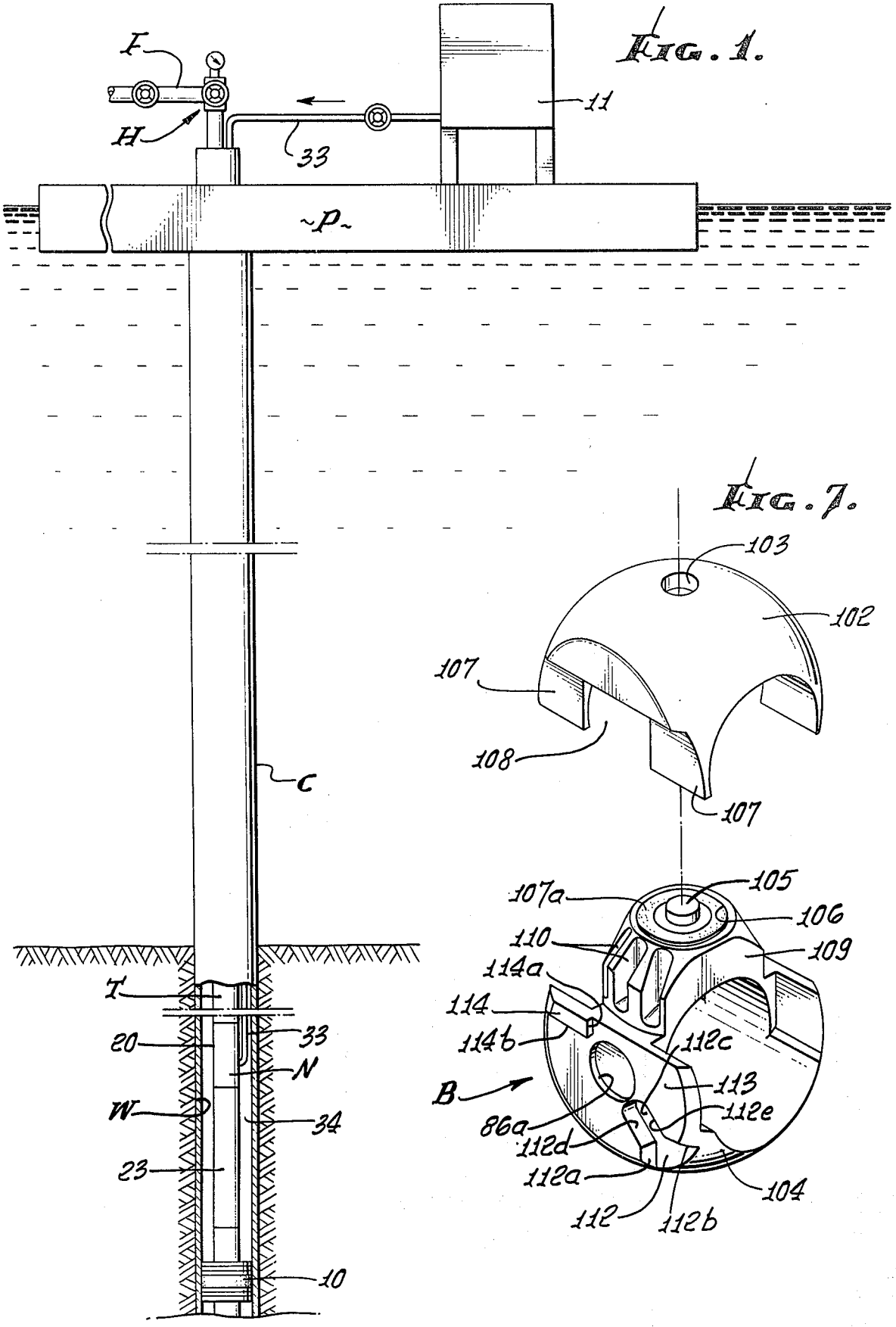
FIG. 7 is an exploded detailed view in perspective of the ball valve.

As seen in the drawings, referring first to FIG. 1, an automatic shutoff valve assembly is adapted to be installed in a string of well production tubing T which extends downwardly through a well casing C which is set in a well bore W, the tubing T having a landing nipple N for receiving a valve assembly which is retrievably seated therein by wireline tools, as will be later described. The tubing T and casing C extend upwardly through a body of water to a platform P. On the platform is a conventional valved tubing head H from which a flow line F extends, the flow line being adapted to conduct well fluids to a suitably located reservoir. A packer 10 is set in the casing C and forms a seal between the tubing T and the casing below the seating nipple N.

The flow of fluid upwardly through the tubing T is controlled by the valve assembly V of FIGS. 2*a* through 2*e*. It will be seen that the landing nipple N is an elongated tubular body 20 threadedly connected at 21 to the lower end of the tubing T and threadedly connected at 22 at its lower end to a downwardly extending tubular body or member 23, which may be several or thousands of feet in length, and which is disposed between the landing nipple and the packer 10. Such landing nipples typically have an internal groove 24 between an upwardly facing seat or shoulder 25 and a downwardly facing shoulder 26. The valve assembly V lands upon the shoulder 25, and latch means 27 engage the shoulder 26 to retain the valve assembly against upward displacement.

Below the groove 24, the landing nipple body 20 has an upper cylindrical sealing bore 28 and a downwardly spaced cylindrical sealing bore 29, between which bores is an enlarged space or bore 30. The nipple body 20 has a port 31 extending radially into the enlarged bore 30 in which a connector fitting 32 connects the control fluid tubing 33 which extends downwardly from the pressure source 11 in the tubing-casing annulus 34 to the landing nipple N, whereby, as will be later described, when the safety valve assembly V is seated and latched in the landing nipple N, control fluid is applicable to the safety valve.

The valve assembly V is an elongated assembly adapted to be run into the landing nipple N and retrieved by means of a wireline tool, as is well known. An elongated tubular valve body assembly 35 has an upper threaded neck 36 on which a tubular body 37 is threadedly connected at 38, the body 37 being connected at 39, at its upper end, to a running and retrieving head 40. The head 40 has a neck 41 providing a downwardly facing shoulder 42 for engagement by a wireline running tool or a wireline retrieving tool (not shown). The latch means 27 comprises a plurality of collet or latch fingers 43 depending from a supporting ring 44 which seats on a shoulder 45 of the body 37 and is retained in place by the head 40. The body 37 has elongated slots 46 which enable the fingers 43 to be flexed inwardly. At the lower ends of the latch fingers 43 are outwardly projecting latch lugs 47 adapted to project into the groove 24 of the landing nipple body 20 for engagement beneath the shoulder 26 for retaining the valve assembly in the nipple body 20, with a downwardly facing shoulder 48 on the body 37 supporting the valve assembly on the shoulder 25 of the nipple body 20. A retainer sleeve 49 is reciprocably disposed in the body 37 and is biased upwardly by a coiled spring 50 disposed between a head flange 51 of the sleeve 49 and the upper end neck 36 of the valve assembly. The body 37 and the sleeve have openings 52 and 53, respectively, to prevent fluid entrapment or bias. As is well known, a running tool is engageable with the neck 41 and is operable to hold the retainer sleeve 49 in a lower position enabling the collet fingers to flex inwardly as the assembly lands in the nipple body 20, and when the running tool is removed, the sleeve 49 is forced upwardly by the spring 50 to hold the fingers 43 outwardly, as shown in the latching position of FIG. 2*a*.

The valve assembly V comprises an elongated tubular body structure including an upper tubular seal mandrel or body section 54 having the neck 36 thereon. This mandrel 54 has side sealing ring means 55 engaged in nipple body 20. Another lower seal mandrel or body section 56 has lower side sealing ring means 57 engageable in the lower sealing bore 29 of the seating nipple body 20.

Figure 2A:
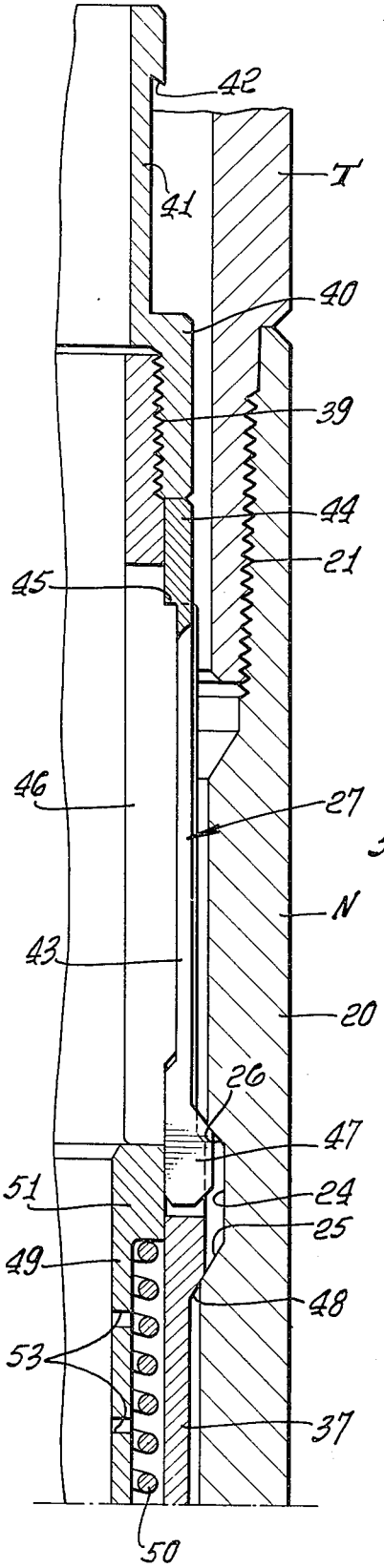
Figure 2B:
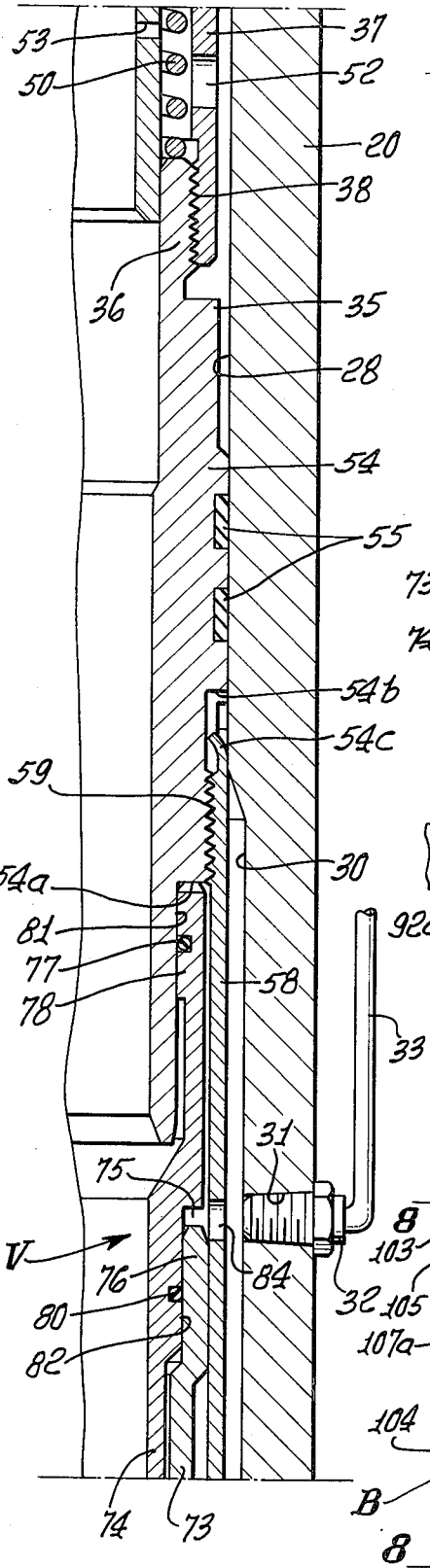
Figure 2C:
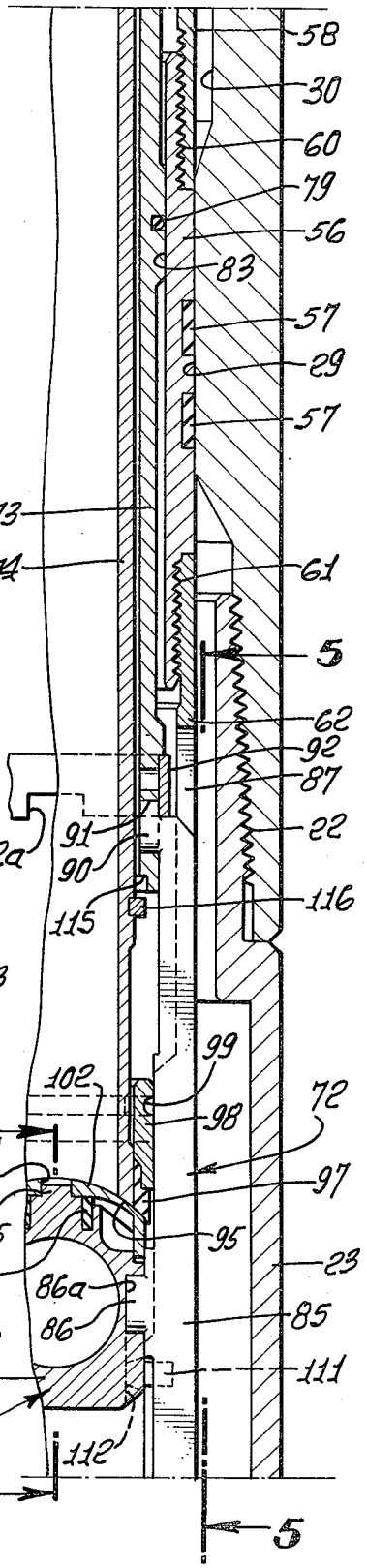
Figure 2D:
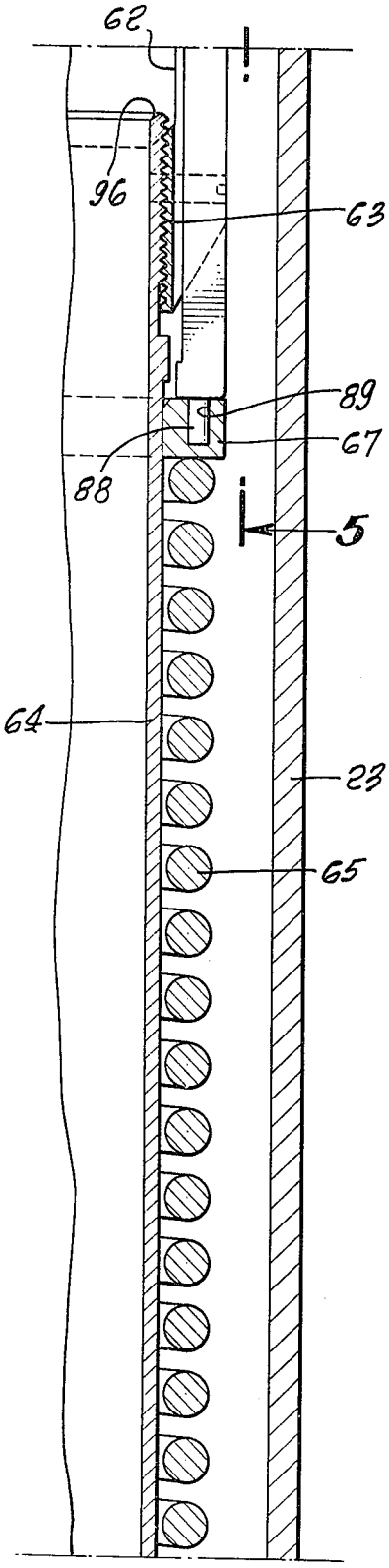
Figure 2E:
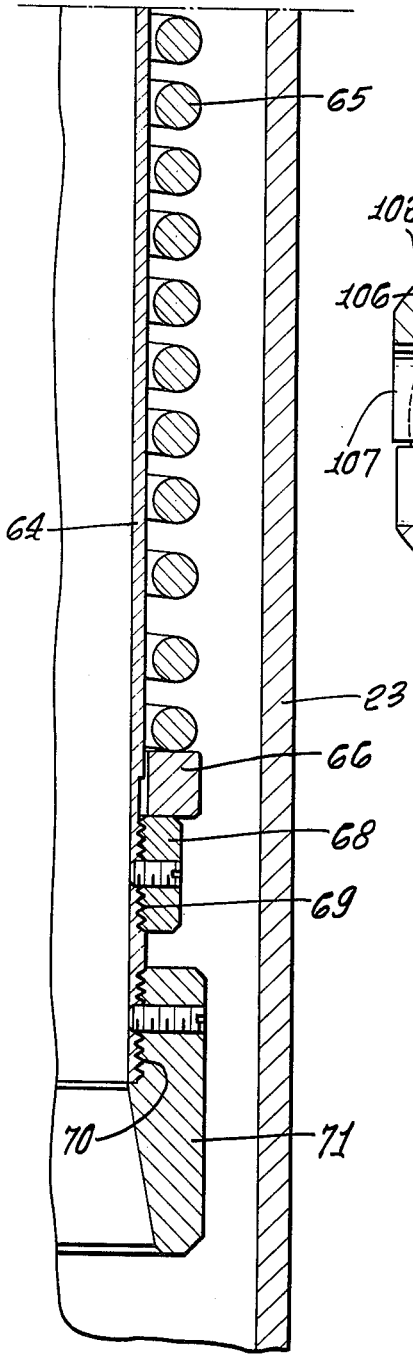

Adjustable means, including a tubular sleeve 58, interconnects the upper and lower seal mandrels 54 and 56 together. This sleeve 58 is threadedly connected at 59, as seen in FIG. 2*b*, to the upper seal mandrel 54 and is threadedly connected at 60, as seen in FIG. 2*c*, to the lower seal mandrel 56. The lower seal mandrel 56 is threadedly connected at 61 to a lower valve body section 62 which extends downwardly to a lower threaded connection 63, as seen in FIG. 2*d*, to a further downwardly extended internal spring seat and guide sleeve 64, about which a coiled spring 65 is disposed.

This spring 65 seats at its lower end on a ring 66, and at its upper end the spring 65 engages a seat ring 67 slidably disposed on the spring guide sleeve 64. The lower spring seating ring 66 abuts with a stop collar 68 which is threaded at 69 onto the guide sleeve 64 for adjustment of the compressed force of the spring 65.

At its lower end, the spring guide sleeve 64 is threaded at 70 to receive a guide nose 71. The upper spring seating ring 67 acts, under the pressure of spring 65, upwardly on a ball valve supporting means 72, later to be described, which is connected at its upper end to an elongated piston sleeve 73.

This piston sleeve 73 is reciprocably disposed about an inner valve seating sleeve 74. The connector sleeve 58, the lower seal mandrel 56, and the upper seal mandrel 54 cooperate to form a piston chamber 75 with the sleeve 74, in which the upper piston end 76 of the elongated piston sleeve 73 is disposed. The piston chamber 75 is defined between an upper seal ring 77 on the upper end section 78 of the seating sleeve 74, a lower seal ring 79 carried by the piston sleeve 73, and an upper seal ring 80 carried by the piston sleeve 73. The upper seal ring 77 engages in a sealing bore 81 of the seal mandrel 54 below the threaded connection 59 between the adjustable sleeve 58 and the mandrel 54. The seal ring 80 is disposed between the upper piston end 76 and a sealing bore 82 within the seating sleeve 74. At its lower end, the piston chamber 75 is sealed by engagement of the seal 79 in the sealing bore 83 of the lower seal mandrel 56.

Control fluid pressure is admitted to the piston chamber 75 from the enlarged bore 30 of the seating nipple body 20, through one or more radial ports 84 in the adjustable connector sleeve 58. This sleeve 58 can be thin-walled to provide space for the internal components and a large flow passage, since the sleeve 58 is pressure balanced between its interior and its exterior between the upper connection 59 with the sealing mandrel 54 and its lower connection 60 with the lo;wer sealing mandrel 56.

Control fluid pressure applied to the piston chamber 75 can act on the upper end 76 of the piston sleeve 73 and overcome the upward bias of the spring 65 to force the ball valve supporting means 72 downwardly so that, as will be later described, the valve means will be opened. The means 72 for supporting the ball valve B comprises a pair of diametrically spaced arms or elongated support members 85 disposed in opposed relation and having transversely aligned pivot pins or lugs 86 on which the ball valve B is pivotally mounted. These arms 85 are disposed in elongated windows 87 in the valve body sleeve 62 and are interconnected with the lower end of the piston sleeve 73 and the spring seating ring 67.

At their lower ends, the pivot arms 85 have pins 88 received in sockets 89 in the ring 67. At their upper ends, the pivot arms 85 have inwardly offset and upwardly extended lugs 90 received in recesses 91 in the piston sleeve 73, the lugs 90 being held in the recesses 71 by a keeper ring 92. For assembly purposes, it will be seen that the end lugs 90 of the arms enable the arms to spread apart towards their lower ends before the lower end pins 88 are engaged in the sockets 89 of the ring 67, thereby enabling the pivot lugs or pins 86 to be engaged in the diametrically spaced recesses 86*a* of the ball valve B. The retaining ring has notches 92*a* adapted to register with the recesses 91 of the keeper ring during assembly, and then the keeper ring is rotated to a position holding the lugs 90 in the piston sleeve.

Figure 11:
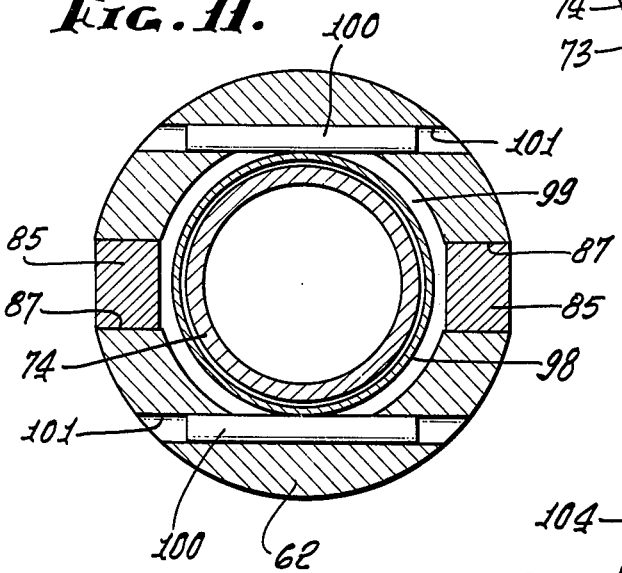
FIG. 11 is a horizontal section as taken on the line 11—11 of FIG. 3*b;*.

The valve sealing sleeve 74 has at its lower end a spherical valve engaging and sealing surface 95 engageable with the spherical surface of the valve ball member B. The ball valve B seals against the spherical end surface 95 on the sleeve 74 and a lower spherical surface 96 on the upper end of the spring guide 64. It can also seal against an elastomeric sealing ring 97 supported by a carrier ring 98 secured to the body 62. The carrier ring 98, as best seen in FIG. 11, has a groove 99 in its outer periphery adapted to receive roll pins 100 which extend through openings 101 in the body 62 and support the ring 98 and seal 97 in position for sealing engagement with the ball valve B when it is closed.

Figure 8:
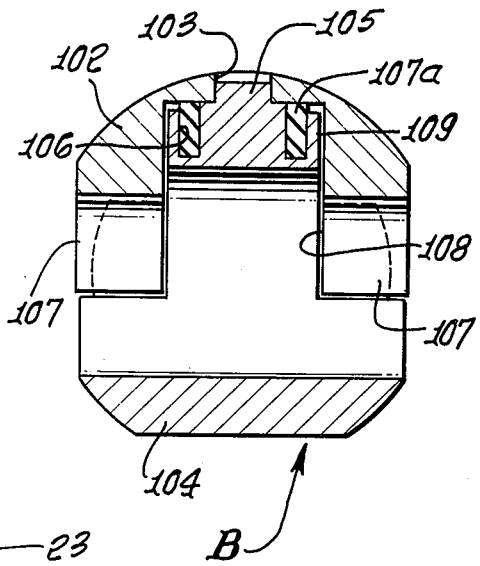
FIG. 8 is a fragmentary detailed view in section showing the ball valve and taken on the line 8—8 of FIG. 2*c;*
Figure 3A:
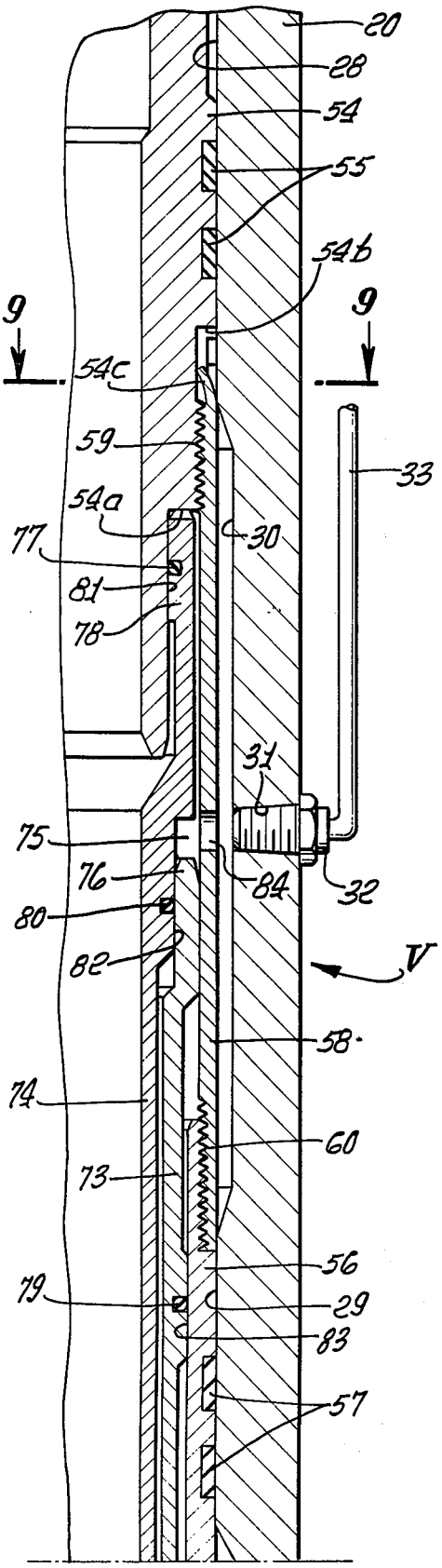
Figure 3B:
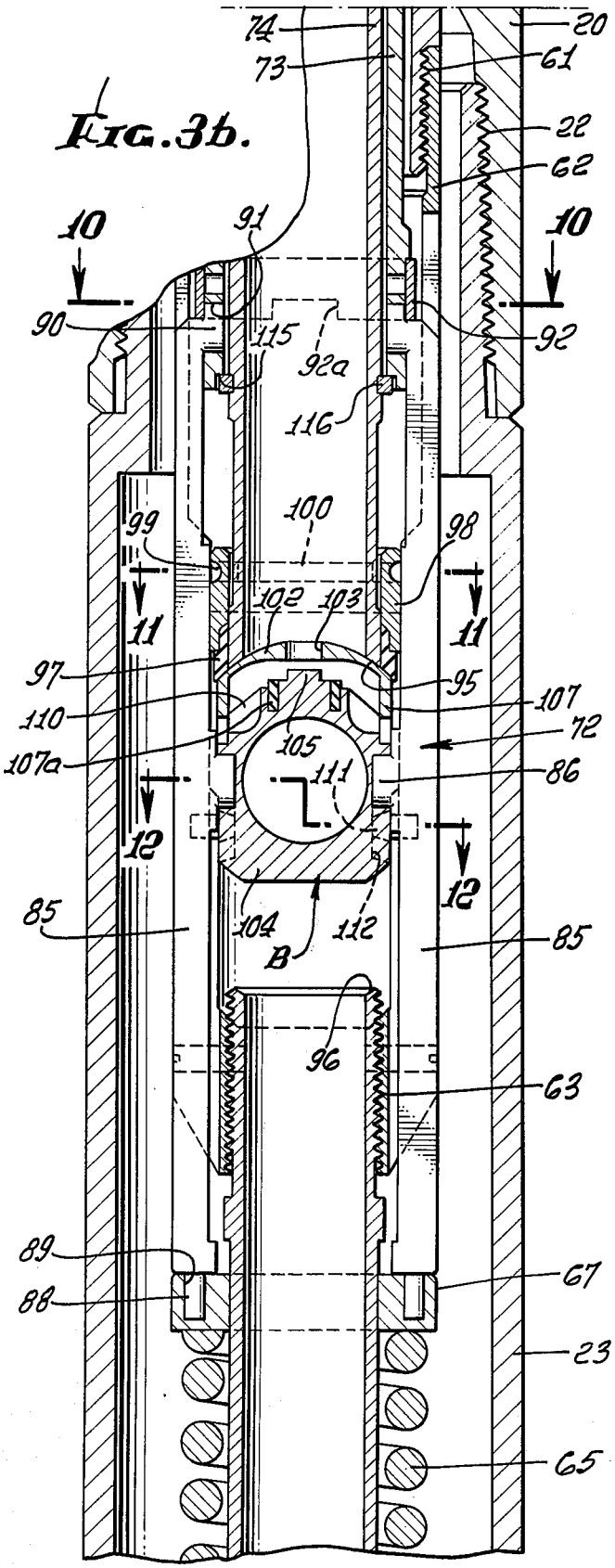

When the ball valve B is in the closed position, it is preferred that pressure across the ball valve be equalized before the ball valve is opened, thereby relieving the operating mechanism of the resistance caused by the pressure imbalance. In accordance with the present invention, equalizing or balancing valve means are incorporated in the ball valve structure, as best seen in FIGS.2*c*, 3*b* and 8. More particularly, the ball valve B has a cap 102 having a central opening or port 103. The body or base 104 of the ball valve B has a stem 105 adapted to extend into the opening 103. Molded into an annular groove 106 about the stem 105 is a resilient seal ring 107*a*. The cap 102 and the base 104 have interengaged means for interlocking the cap and ball together for rotation as a unit between the positions of FIG. 2*c* and FIG. 4*b*, including inwardly extended portions or ribs 107 on the cap 102, spaced apart to form a slot 108, the slot receiving a companion body portion 109 of the base 104. When the cap is off of the ball base, as seen in FIG. 3*b*, fluid can flow through the cap port 103 to equalize pressure across the ball valve and the companion rib portions 107 and 109 retain the ball and cap engaged for unitary rotation, but when, as seen in FIG. 2*c*, the cap is seated, the by-pass port 103 is closed.

The fluid which by-passes the ball valve may contain dirt and solid particles too large to pass through the port 103. Such particles may tend to block the by-pass passage. Accordingly, the ball valve includes means for screening the fluid during the equalization of pressure. For this purpose, the rib or body section 109 of the ball base 104 has a number of spaced grooves 110 providing by-pass flow passages smaller in cross-section than the port 103 in the cap. When the ball valve B is closed, as seen in FIG. 2*c*, it is desired that the lower sealing end 95 of the sealing sleeve 74 be in sealing engagement with the spherical surface of the ball cap 102. Upward movement of the sealing sleeve 74 is limited by abutting engagement of the upper end section 78 with a shoulder 54*a* (FIG. 2*b*) of the upper seal mandrel 54. Initial positioning of the ball valve relative to the end sealing surface 95 of the sleeve 74 is enabled by the threaded connection 59 between the connector sleeve 58 and the uppper seal mandrel 54. This threaded connection can be adjusted to shift the ball valve towards the sealing sleeve 74, and means are provided for locking the parts in adjusted condition. For this purpose, as shown, the seal mandrel 54 has a number of circumferentially spaced notches or grooves 54*b* into which a tab 54*c* on the upper end of the connector sleeve 58 is deformable to interlock the parts in a selected adjusted position, with the ball valve disposed for sealing engagement with the sealing sleeve 74 and the resilient seal ring 97.

Figure 4A:
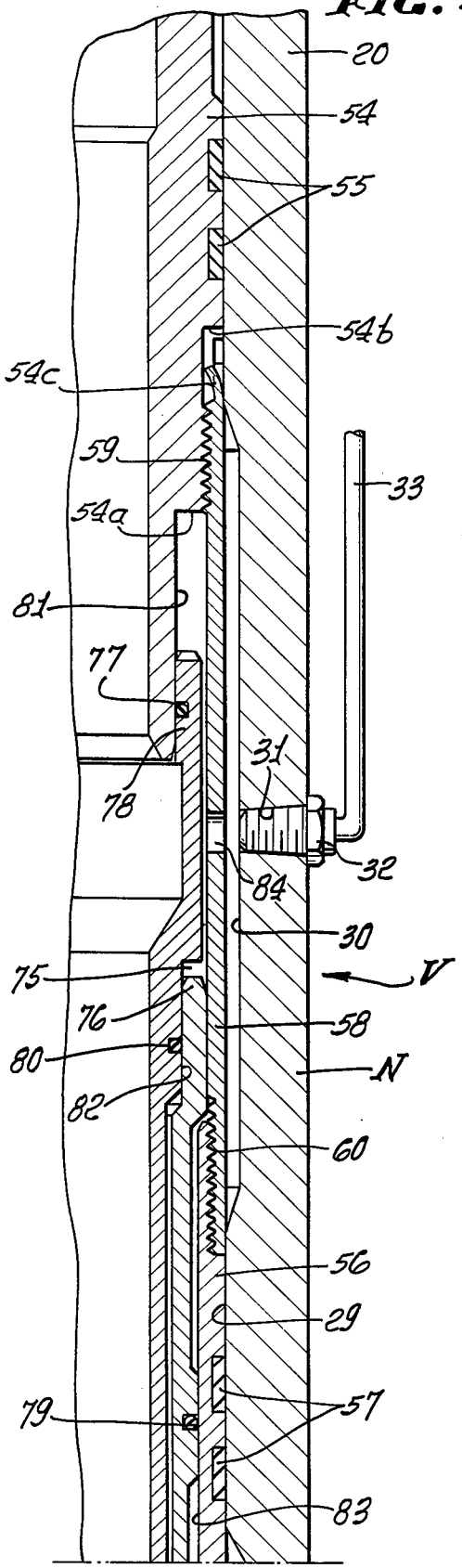
Figure 4B:
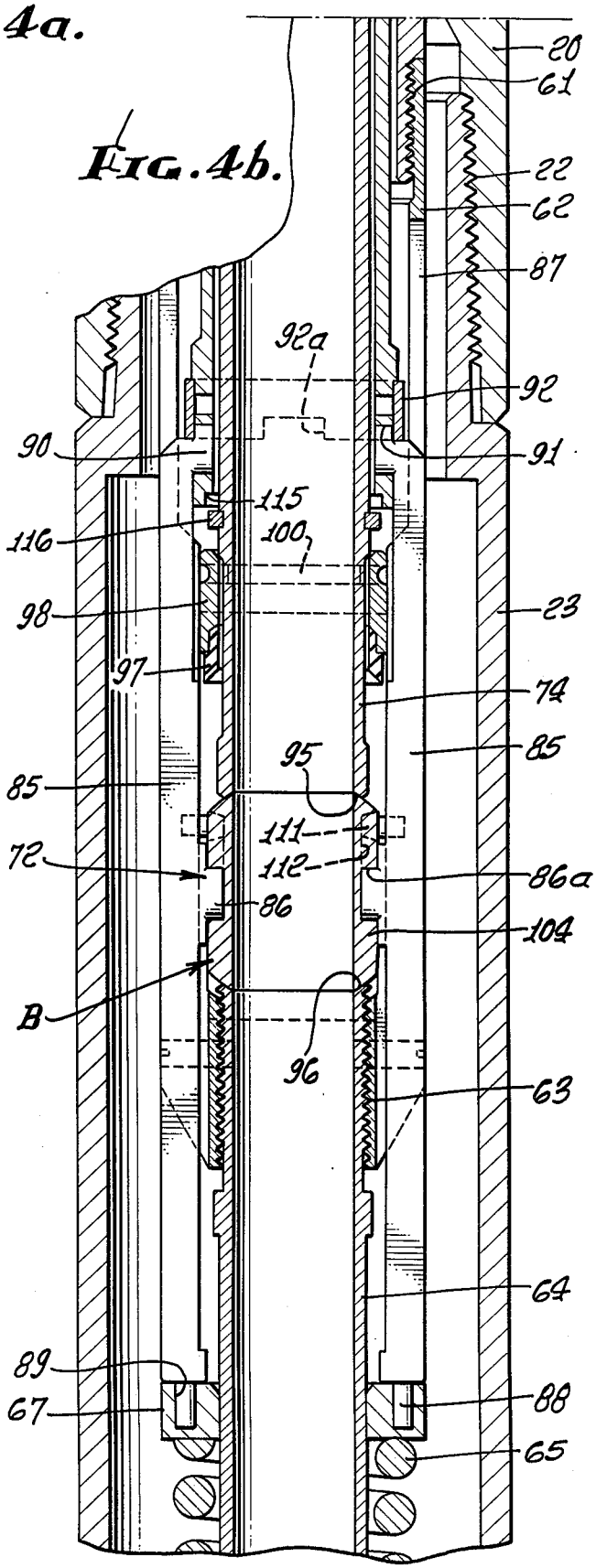
Figure 6:
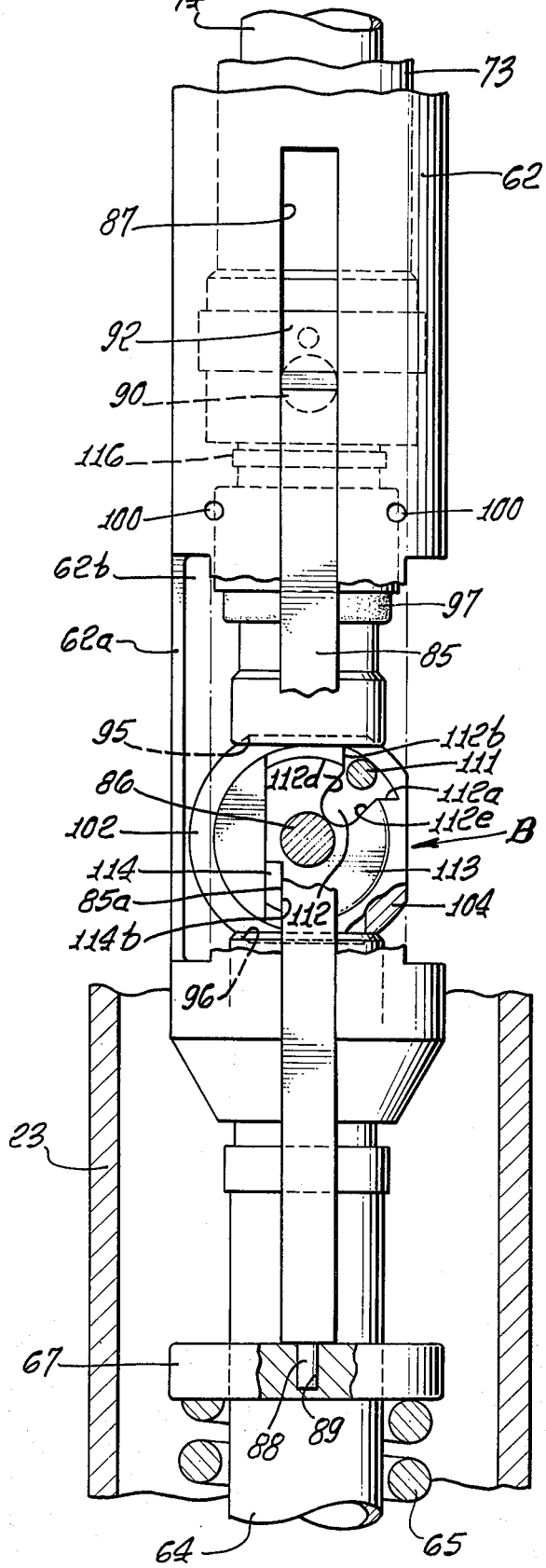
FIG. 6 is a view corresponding to FIG. 5, but showing the valve rotated to the open position.
Figure 9:
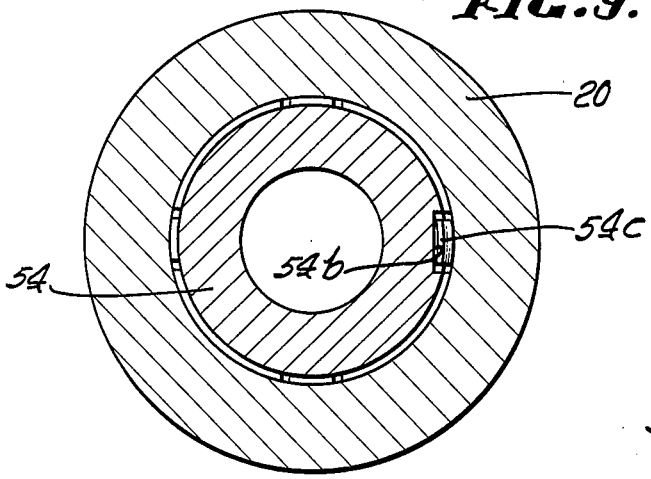
FIG. 9 is a horizontal section as taken on the line 9—9 of FIG. 3*a;*
Figure 10:
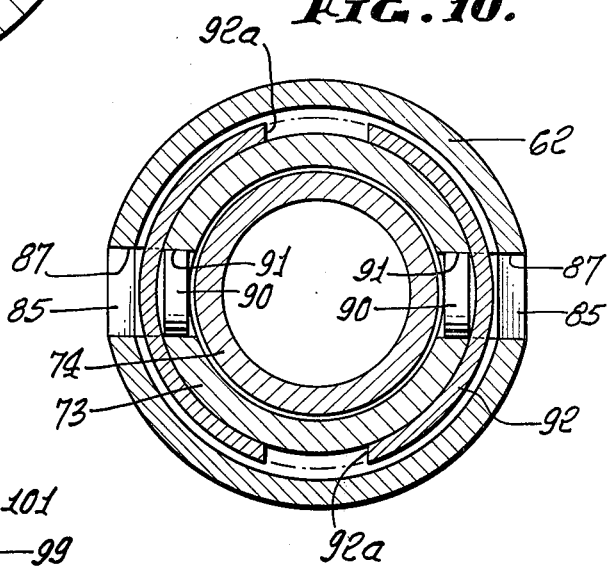
FIG. 10 is a horizontal section as taken on the line 10—10 of FIG. 3*b;*

Downward movement of the piston sleeve 73 is effective to actuate the ball valve from the closed position of FIGS. 2*a*–2*e* and to the open position of FIGS. 4*a*, 4*b* and 6. Initially, however, the pressure across the closed ball valve is equalized, as seen in FIGS. 3*a* and 3*b*. Such actuation of the ball valve is caused by pin 111 and slot 112 means on the valve body and in the ball base, respectively.

Figure 5:
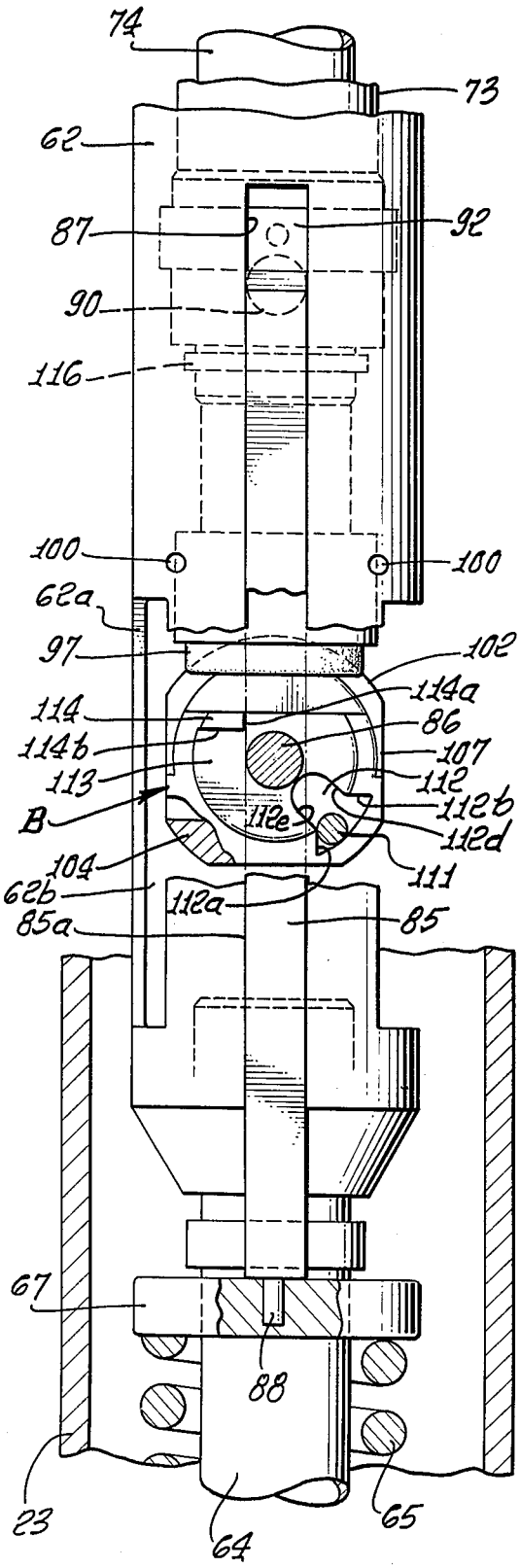
FIG. 5 is a fragmentary detail view, partly in vertical section and partly in section, as taken on the line 5—5 of FIG. 2*c;*

The relationship of the ball valve actuating pin 111 and the slot 112 is best seen in FIGS. 5 and 6, it being understood that the ball valve base 104 may have identical slots 112 at its opposite sides engaged by diametrically opposite pins 111. More particularly, the ball valve base member 104, on each of its opposite sides, has a chordal flat surface 113 adjacent to the diametrically opposite bars or arms 85 of the ball support means 72. The slot 112 extends radially with respect to the axis of rotation of the ball valve member 104, and in radial alignment with the slot 112 a stop lug 114 projects outwardly from the flat surface 113 and provides a pair of right angularly related stop surfaces 114a and **114*b*. When the ball valve member is in the position of FIG. 5, the stop surface 114a engages the vertical side wall 85a of the adjacent support arm 85, thereby limiting rotation of the valve member to the position at which the valve is closed. The stop surface 114b on the stop lug 114 engages the bar surface 85a, as shown in FIG. 6, to limit rotation of the valve member to the position at which the valve is open. Such rotation between the closed and open positions is caused by longitudinal or vertical movement of the valve member, the two longitudinal extremes being shown in FIGS. 5 and 6**.

As previously indicated and as will later be more fully described, the ball base member 104 is actuated or shifted longitudinally by longitudinal movement of the piston 73. The slot 112 is formed in such a manner as to cause such rotation of the valve member as the latter moves vertically or longitudinally. Thus, as seen in FIGS. 5, 6 and 7, the mouth of the slot 112 is formed in the valve base member 104 by opposed walls which are disposed at a right angle to one another and designated **112*a* and 112*b*, and which, respectively, are parallel to the stop surfaces 114*a* and 114*b*. At the apex of the angle defined between the walls 112*a* and 112*b*, the slot 112*c* opens inwardly and has walls 112d and 112*e*. The relationship between the pin 111 and the walls 112*b* and 112*d* is such that some longitudinal downward movement of the ball valve will occur without rotation of the ball valve, but when the pin 111 engages walls 112*b* and 112*d*, it will be rotated until the pin 111 clears wall 112*b* and stop surface 114*b* engages the bar wall 85*a* (FIG. 6). Thereafter, downward movement of the ball valve will occur without rotation. Conversely, if the ball valve is in the position of FIG. 6, some longitudinal upward movement of the ball valve will occur before the pin 111 engages the walls 112a and 112e. Continued upward movement will rotate the ball valve until stop surface 114a engages the bar wall 85*a* and pin 111 clears wall 112*a*. Thereafter, continued upward movement of the ball valve will occur without rotation. Such free or lost motion connection of the ball valve and the rotating pin 111** not only relieves the connection of damaging forces when the ball valve is in either of its closed or opened positions, but provides the travel required for full functioning of the valve, as will now be described.

The operation of the invention described above is as follows:

The tubing string is run into the well to the desired location, the packer 10 sealing off the annulus between the tubing and the casing C and the control fluid conduit is simultaneously run into the well with the tubing T.

The safety valve is normally closed, as seen in FIGS. 2a through 2e and in FIG. 5, when the pressure of control fluid in the control fluid pressure chamber 75 is relieved, and the spring 65 acts upwardly on the lower ends of the pivot arms 85 to bias the piston 73 upwardly. The upward movement of the piston 73 and arms 85, acting through the pivot pins 86, carries the ball valve upwardly so that the valve rotating pins 111 engaging the cam surface 112e rotate the ball valve to the closed position (FIG. 5). Inasmuch as the cam surface **112*a* clears the pin 111, the ball valve is permitted to have a certain amount of longitudinal overtravel so that it moves into sealing engagement with the sealing end 95 of the sleeve 74 and the resilient seal 97 longitudinally, and without rotation. Upward travel of the seating or sealing sleeve 60** is limited as previously described.

When control fluid pressure is applied to the pressure chamber 75 through the control fluid tubing 33 from the top of the well, a downward force is applied to the piston 73 to overcome the force of the spring 65. The piston 73 can move downwardly relative to the sealing sleeve 74 until the shoulder 115 at the lower end of the piston sleeve 73 engages a stop ring 116 on the sealing sleeve 74, as shown in FIG. **3*b*. During this initial increment of downward movement of the piston sleeve 73 and consequently the ball valve base 104, differential fluid pressure maintains the cap 102 in sealing contact with the lower end of the sealing sleeve 74 and the resilient seal 97, and prevents downward movement of the sealing sleeve 74, until such time as the ball base has moved from the position of FIG. 2*c* to the position more particularly illustrated in FIG. 3*b*, at which the port 103 through the ball cap is open and fluid pressure is equalized across the cap, thereby enabling the fluid pressure acting downwardly on the sleeve 74 to shift the cap into sealing engagement with the base to complete the spherical or ball member, as shown in FIG. 2*c*, the valve seating sleeve 74 and the piston 73 then being moved together by the fluid pressure in the chamber 75** to shift the ball longitudinally and effect its rotation.

As the ball valve moves downwardly, the rotating pins 111 will contact the slot surfaces **112*d*, thereby rotating the ball valve from the closed position of FIG. 5 to the open position of FIG. 6, such open position also being shown in FIG. 4*b*, wherein the valve closing spring 65 has been compressed by the pivot arms 85 and ring 67 and the spherical sealing surface 96 on the lower valve sealing sleeve and spring guide 64 and the ball valve base and cap are sealingly engaged. At this point, further downward movement of the ball valve is prevented, and the sealing contact between the sealing surfaces of the lower sealing sleeve and the upper sealing sleeve with the ball valve is maintained by fluid pressure. The threaded connection 63 between the guide sleeve 64 and the body 62 enables adjustment of the relationship between the lower seat surface 96** and the ball.

If, for any reason, the control fluid pressure in the pressure chamber 75 acting downwardly on the piston 73 should be relieved, such as by reason of fracture of the control fluid conduit 33 or the purposeful venting of the control fluid pressure at the platform P, the valve closing spring 65 will assist well fluid pressure acting upwardly to overcome any residual control fluid pressure to effect the closing operation by shifting the piston sleeve 73 upwardly, thereby carrying the ball valve therewith for closing actuation of the ball by the ball rotating pins 111.

Figure 12:
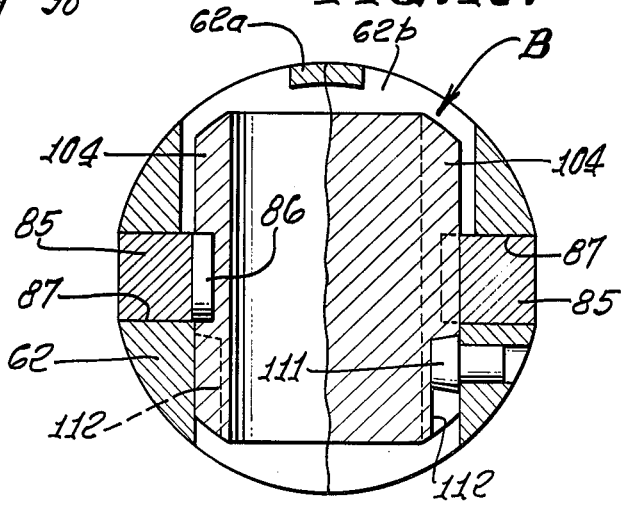
FIG. 12 is a horizontal section as taken on the line 12—12 of FIG. 3*b*.

By referring to FIGS. 5, 6 and 12, it will be noted that the valve body includes a bar 62*a* running along one side of a window 62*b* cut in the valve body 62, this bar being disposed at that side of the window along which the cap 102 will move as the ball member B rotates in shifting between the valve closes condition shown in FIG. 5 and the open condition shown in FIG. 6. When the ball valve is in the open condition, the bar 62*a* prevents the ball cap 102 from falling out through the left side of the window (as seen in FIG. 6), since the cap 102 can move a very slight distance only before it contacts the bar. Moreover, if the cap is in its position elevated from the base 104, such as disclosed in FIG. 3b, any attempt to rotate the ball member B would result in the cap 102 engaging the bar, which would prevent the cap from rotating from its position engaging the sleeve 74. The cap 102 and the ball base 104 must be together, as shown in FIG. 5, before the ball member B can be shifted from its closed position illustrated in FIG. 5 to its open position illustrated in FIG. 6. With the cap and ball base together, the ball member B is permitted to be rotated in a counterclockwise direction, as seen in FIG. 5, the cap 102 clearing the bar 62*a*. This bar cannot interfere with the continued rotation of the ball member B in the counterclockwise direction to the valve opening condition illustrated in FIG. 6.

I claim:

1. In a subsurface shutoff valve for wells adapted to be supported in a well fluid production pipe: a body having a flow passage therethrough; shutoff valve means including a ball valve shiftable between a first position closing said passage and a second position at which said passage is open; actuator means for shifting said ball valve between said positions, including means defining a control fluid pressure chamber for moving said ball valve to said second position, and means responsive to the pressure of well fluid in the production pipe for biasing said ball valve to said first position upon reduction in the pressure of control fluid in said chamber; said shutoff ball valve including by-pass valve means, and a passage for equalizing the well fluid across said shutoff valve means before said member is moved from said first position to said second position, and screen means for limiting entry of solids into said equalizing passage.

2. In a subsurface shutoff valve as defined in claim 1; said ball valve having said flow passage therethrough and a spherical sealing surface, said actuator means comprising actuator piston means movable longitudinally in said body responsive to control fluid pressure in said chamber, a seating sleeve having a sealing end surface engageable with said spherical sealing surface of said ball, said piston means and said sleeve being relatively longitudinally movable to open and close said by-pass valve means, and including means for rotating said ball valve between said first and second positions responsive to longitudinal movement of said actuator sleeve.

3. In a subsurface shutoff valve as defined in claim 1; said ball valve having said flow passage therethrough and a spherical sealing surface, said actuator means comprising actuator piston means movable longitudinally in said body responsive to control fluid pressure in said chamber, a seating sleeve having a sealing end surface engageable with said spherical sealing surface of said ball, said piston means and said sleeve being relatively longitudinally movable to open and close said by-pass valve means, and including means for rotating said ball valve between said first and second positions responsive to longitudinal movement of said actuator sleeve, and spring means acting on said piston means for opposing said control fluid pressure.

4. In a subsurface shutoff valve as defined in claim 1; said ball valve comprising a base and a cap, said cap having said equalizing passage, and said screen means including portions of said base defining flow paths smaller than said equalizing passage.

5. In a subsurface shutoff valve as defined in claim 1; said ball valve comprising a base and a cap, said cap having said equalizing passage, said screen means including grooves in said base communicable with said passage when said cap is elevated with respect to said base, none of said grooves being greater in width than the diameter of said equalizing passage.

6. In a subsurface shutoff valve as defined in claim 1; said ball valve comprising a base and a cap, said cap having said equalizing passage, and said screen means including portions of said base defining flow paths smaller than said equalizing passage, said base having a stem for projecting into said equalizing passage, said by-pass valve means including a resilient seal around said stem and engageable between said base and said cap.

7. In a subsurface shutoff valve for wells adapted to be supported in a well fluid production pipe: an elongated tubular body; an elongated inner tubular assembly including piston sleeve means, a ball valve having a flow passage therethrough, support means for said ball valve carried by said piston sleeve means; cooperable means on said ball valve and said body for rotating said ball valve between first and second positions at which said flow passage is open and closed, respectively, in response to longitudinal movement of said piston sleeve means and said ball valve in opposite directions in said tubular body, said piston sleeve means and said tubular body defining a chamber for control fluid pressure; and shifting means for moving said piston sleeve means and said ball valve upwardly, said support means including a pair of pivot arms at opposite sides of said ball valve and having means pivotally supporting said ball, said pivot arms being initially disassembled from said piston sleeve means, and means connecting said pivot arms to said piston sleeve means.

8. In a subsurface shutoff valve as defined in claim 7; said cooperable means for rotating said ball comprising rotary drive means which are released to enable free further longitudinal movement of said sleeve means and said ball when said ball is in said positions.

9. In a subsurface shutoff valve as defined in claim 7; said shifting means including a spring acting on said sleeve means to bias the latter and said ball valve upwardly.

10. In a subsurface shutoff valve as defined in claim 7; said tubular body including a lower tubular sleeve below said ball valve, said shifting means including a spring surrounding and supported by said lower sleeve and acting on said sleeve means to bias said sleeve means and ball valve upwardly.

11. In a subsurface shutoff valve as defined in claim 10; the upper end of said lower sleeve being engageable by said ball valve when said ball valve is in said first position.

12. In a subsurface shutoff valve as defined in claim 10; means mounting said lower tubular sleeve for longitudinal adjustment with respect to the tubular body thereabove.

13. In a subsurface shutoff valve as defined in claim 7; said means connecting said pivot arms to said piston sleeve means including means enabling spreading to said arms during connection with said ball valve, and including means engaging said arms for holding said arms against spreading following connection of said arms with said piston sleeve means.

14. In a subsurface shutoff valve for wells adapted to be supported in a well fluid production pipe: a body having a flow passage therethrough; shutoff valve means including a ball valve shiftable between a first position closing said passage and a second position at which said passage is open; actuator means for shifting said ball valve between said positions, including means defining a control fluid pressure chamber for moving said member to said second position, and means responsive to the pressure of well fluid in the production pipe for biasing said ball valve to said first position upon reduction in the pressure of control fluid in said chamber; said shutoff ball valve including a by-pass passage for equalizing the well fluid across said shutoff valve means before said ball valve is moved from said first position to said second position, said ball valve having a flow passage therethrough adapted to communicate with said body flow passage, said ball valve having a spherical sealing surface, said actuator means comprising actuator piston means movable longitudinally in said body responsive to control fluid pressure in said chamber, an upper seating sleeve having a sealing end surface engageable with said spherical sealing surface of said ball valve, said piston means and said sleeve being relatively longitudinally movable to open and close said by-pass passage, means for rotating said ball valve between said first and second position responsive to longitudinal movement of said actuator sleeve, and a lower seating sleeve secured to said body and having a sealing end surface engageable with said spherical seal surface of said ball valve.

15. In a subsurface shutoff valve as defined in claim 14; and means for communicating said pressure chamber with said upper seating sleeve, whereby fluid pressure in said chamber acts on said seating sleeve to urge its sealing end surface against said ball valve.

16. In a subsurface shutoff valve for wells adapted to be supported in a well fluid production pipe; a body having a flow passage therethrough; shutoff valve means including a ball valve shiftable between a first position closing said passage and a second position at which said passage is open; actuator means for shifting said ball valve between said positions, including means defining a control fluid pressure chamber for moving said member to said second position, and means responsive to the pressure of well fluid in the production pipe for biasing said ball valve to said first position upon reduction in the pressure of control fluid in said chamber; said shutoff ball valve including a by-pass passage for equalizing the well fluid across said shutoff valve means before said ball valve is moved from said first position to said second position, said ball valve having a flow passage therethrough adapted to communicate with said body flow passage, said ball valve having a spherical sealing surface, said actuator means comprising actuator piston means movable longitudinally in said body responsive to control fluid pressure in said chamber, a seating sleeve having a sealing end surface engageable with said spherical sealing surface of said ball valve, said piston means and said sleeve being relatively longitudinally movable to open and close said by-pass passage, and including means for rotating said ball valve between said first and second positions responsive to longitudinal movement of said actuator sleeve; means for adjusting the position of said ball valve and said sealing end surface of said sleeve with respect to each other.

17. In a subsurface shutoff valve as defined in claim 16; and additional sealing means opposed to said sealing end surface of said sleeve and engageable by said ball valve when said ball valve is open.

18. In a subsurface shutoff valve as defined in claim 16; and additional sealing means opposed to said sealing end surface of said sleeve and engageable by said ball valve when said ball valve is open, and including means for adjusting the relationship between said additional sealing means and said ball valve.

19. In a subsurface shutoff valve for wells adapted to be supported in a well fluid production pipe: a body having a flow passage therethrough; shutoff valve means including a ball valve shiftable between a first position closing said passage and a second position at which said passage is open; actuator means for shifting said ball valve between said positions, including means defining a control fluid pressure chamber for moving said member to said second position, and means responsive to the pressure of well fluid in the production pipe for biasing said ball valve to said first position upon reduction in the pressure of control fluid in said chamber; said shutoff ball valve including a by-pass passage for equalizing the well fluid across said shutoff valve means before said ball valve is moved from said first position to said second position, said ball valve having a flow passage therethrough adapted to communicate with said body flow passage, said ball valve having a spherical sealing surface, said actuator means comprising actuator piston means movable longitudinally in said body responsive to control fluid pressure in said chamber, a seating sleeve having a sealing end surface engageable with said spherical sealing surface of said ball valve, said piston means and said sleeve being relatively longitudinally movable to open and close said by-pass passage, and including means for rotating said ball valve between said first and second positions responsive to longitudinal movement of said actuator sleeve, means for biasing said ball valve to a closed position including a coiled compression spring, and a guide internally of said spring secured to said body and against which said spring bears.

20. In a subsurface shutoff valve as defined in claim 14; said spring surrounding said guide with its lower end seated against said guide and with its upper end bearing against said actuator means.

21. In a subsurface shutoff valve as defined in claim 19; said spring surrounding said guide with its lower end seated against said guide and with its upper end bearing against said actuator means, and releasable latch means on said body operable by a wireline tool for releasably latching said shutoff valve in the production pipe.

22. In a subsurface shutoff valve for wells adapted to be supported in a well fluid production pipe: a body having a flow passage therethrough; shutoff valve means including a ball valve shiftable between a first position closing said passage and a second position at which said passage is open; actuator means for shifting said ball valve between said positions, including means defining a control fluid pressure chamber for moving said member to said second position, and means responsive to the pressure of well fluid in the production pipe for biasing said ball valve to said first position upon reduction in the pressure of control fluid in said chamber; said shutoff ball valve including a by-pass passage for equaling the well fluid across said shutoff valve means before said ball valve is moved from said first position to said second position, said ball valve having a flow passage therethrough adapted to communicate with said body flow passage, said ball valve having a spherical sealing surface, said actuator means comprising actuator piston means movable longitudinally in said body responsive to control fluid pressure in said chamber, a seating sleeve having a sealing end surface engageable with said spherical sealing surface of said ball valve, said piston means and said sleeve being relatively longitudinally movable to open and close said by-pass passage, and including means for rotating said ball valve between said first and second positions responsive to longitudinal movement of said actuator sleeve, means for biasing said ball valve to a closed position including a coiled compression spring, and an internal guide for said spring, and releasable latch means on said body operable by a wireline tool for releasably latching said shutoff valve in the production pipe.

23. In a subsurface shutoff valve for wells adapted to be operated in a well fluid production pipe: a body having a flow passage therethrough; shutoff valve means including a ball valve shiftable between a first position closing said passage and a second position at which said passage is opened; actuator means for shifting said ball valve between said positions, including means defining a controlled fluid pressure chamber for moving said member to said second position, and means responsive to the pressure of well fluid in the production pipe for biasing said ball valve to said first position upon reduction in the pressure of controlled fluid in said chambers; said actuator means comprising actuator piston means movable longitudinally in said body responsive to control fluid pressure in said chamber, an upper seating sleeve having a sealing end surface, means for rotating said ball valve between said first and second positions responsive to longitudinal movement of said actuator means, and a lower seating sleeve secured to said body and having a sealing end surface engageable with said spherical sealing surface of said ball valve.

24. In a subsurface shutoff valve as defined in claim 23; means for adjusting the position of said ball valve and said sealing end surface of said upper sleeve with respect to each other.

25. In a subsurface shutoff valve as defined in claim 23; and means for adjusting the relationship between said sealing end surface of said lower sleeve and said ball valve.

26. In a subsurface shutoff valve as defined in claim 23; means for adjusting the position of said ball valve and said sealing end surface of said upper sleeve with respect to each other, and means for adjusting the relationship between said sealing end surface of said lower sleeve and said ball valve.

27. In a subsurface shutoff valve as defined in claim 23; means for biasing said ball valve to a closed position including a coiled compression spring surrounding said lower sleeve and against which said spring bears.

28. In a subsurface shutoff valve as defined in claim 23; means for biasing said ball valve to a closed position including a coiled compression spring surrounding said lower sleeve and against which said spring bears, the upper and lower ends of said spring bearing against said actuator means and lower sleeve, respectively.

* * * * *

UNITED STATES PATENT AND TRADEMARK OFFICE

CERTIFICATE OF CORRECTION

PATENT NO. : 3,971,438

DATED : July 27, 1976

INVENTOR(S) : TALMADGE L. CROWE

It is certified that error appears in the above-identified patent and that said Letters Patent are hereby corrected as shown below:

Column 5, line 29, change "lo;wer" to -- lower --.

Column 11, line 5, change "to" to -- of --.

Column 12, line 52, "14" should read -- 19 --.

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademark*